US010082310B2

(12) United States Patent
Deivasigamani et al.

(10) Patent No.: US 10,082,310 B2
(45) Date of Patent: Sep. 25, 2018

(54) USER LOCATION BASED CONTROL OF COMFORT DEVICES

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 328 days.

(21) Appl. No.: 14/832,864

(22) Filed: Aug. 21, 2015

(65) Prior Publication Data

US 2016/0054020 A1 Feb. 25, 2016

Related U.S. Application Data

(60) Provisional application No. 62/040,207, filed on Aug. 21, 2014.

(51) Int. Cl.

| | |
|---|---|
| ***F24F 11/00*** | (2018.01) |
| ***F24F 11/30*** | (2018.01) |
| ***F24F 11/62*** | (2018.01) |
| *F24F 120/10* | (2018.01) |
| *F24F 11/56* | (2018.01) |
| *F24F 11/58* | (2018.01) |

(52) U.S. Cl.

CPC ..... *F24F 11/006* (2013.01); *F24F 11/30* (2018.01); *F24F 11/62* (2018.01); *F24F 11/56* (2018.01); *F24F 11/58* (2018.01); *F24F 2120/10* (2018.01)

(58) Field of Classification Search

CPC ..... F24F 11/006; F24F 11/0034; F24F 2011/0068; F24F 2011/0071

USPC ..... 700/276

See application file for complete search history.

(56) References Cited

U.S. PATENT DOCUMENTS 8,108,076 B2 * 1/2012 Imes ..... F24F 11/006 340/686.6

FOREIGN PATENT DOCUMENTS

WO WO-2009083761 A1 * 7/2009 ..... H04M 1/72572

* cited by examiner

*Primary Examiner* — Robert E Fennema
*Assistant Examiner* — Christopher W Carter
(74) *Attorney, Agent, or Firm* — Tracy Jong Law Firm; Tracy P. Jong; Cheng Ning Jong

(57) ABSTRACT

A method of controlling a comfort device having at least one effector capable of meeting the demand of at least a user, the method includes establishing at least one zone in which at least one service of a comfort device is provided; associating the at least one effector of the comfort device with the least one zone; determining the presence of the at least one user in the at least one zone; and controlling the comfort device to meet the demand of the at least one user.

10 Claims, 3 Drawing Sheets

USER LOCATION BASED CONTROL OF COMFORT DEVICES

PRIORITY CLAIM AND RELATED APPLICATIONS

This non-provisional application claims the benefit of priority from provisional application U.S. Ser. No. 62/040,207 filed on Aug. 21, 2014. Said application is incorporated by reference in its entirety.

BACKGROUND OF THE INVENTION

1. The Field of the Invention

The present invention is directed generally to user location based control mechanisms of comfort devices. More specifically, the present invention is directed to user location based control mechanisms of comfort devices using at least one mobile device associated with a user.

2. Background Art

Conventional control of comfort devices, e.g., space heating and cooling systems and hot water heating systems does not include user location or even user presence as an input to provide targeted heating or cooling or availability of hot water. Without targeted heating or cooling and knowledge of the presence of users, heating or cooling and hot water may be provided to parts of a building where they are not actually used. Unused heating and cooling eventually ends up as wastes as heat, a product of heating, can escape through the shell of the building or ambient heat can be absorbed through the shell of the building, rendering cooling ineffective. In addition to wastes, non-targeted heating or cooling also causes the need to heat or cool the entire building all of the time causing the heating or cooling system delays in achieving its setpoint temperature.

Thus, there is a need for a control system of a comfort device which controls the comfort device according to a user's demand.

SUMMARY OF THE INVENTION

In accordance with the present invention, there is provided a method of controlling a comfort device having at least one effector capable of meeting the demand of at least one user, the method comprising:

(a) establishing at least one zone in which at least one service of a comfort device is provided;

(b) associating the at least one effector of the comfort device with the least one zone;

(c) determining the presence of the at least one user in the at least one zone; and (d) controlling the comfort device to meet the demand of the at least one user.

In one embodiment, the determining step includes comparing a user location obtained via a mobile device to the location of the at least one zone.

In one embodiment, the mobile device is a cell phone. Other embodiments of the mobile device include, but not limited to, a Personal Digital Assistant (PDA), electronic pad, smart phone, key fob, tablet and Global Positioning System (GPS) device.

In one embodiment, the demand of the at least one user is weighted.

In one embodiment, the controlling step includes controlling the comfort device without considering the magnitude of the demand of the at least one user.

In one embodiment, the controlling step includes controlling the comfort device based on the magnitude of the demand of the at least one user.

In one embodiment, the demand of the at least one user further includes a base demand.

In one embodiment, the establishing step includes establishing an imaginary wall representing an entrance to the at least one zone and a point representing the side of the imaginary wall the at least one zone is disposed.

In one embodiment, the establishing step includes establishing a reference location and a boundary disposed at a pre-selected distance from the reference location to define the at least one zone.

In one embodiment, the establishing step includes detecting a Radio Frequency Identification (RFID) tag.

An object of the present invention is to provide a means for controlling a comfort device which results in a more comfortable environment for a user.

Another object of the present invention is to provide a means for controlling a comfort device which results in a more comfortable environment attained in a shorter period of time.

Another object of the present invention is to provide a means for controlling a comfort device which results in a more comfortable environment for a user while reducing wastes by servicing only the user's location and not other unused locations unnecessarily.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—step of comparing current location with zone data
4—step of determining whether a mobile device is in a climate control zone
6—step of determining whether climate control is enabled
8—step of adding demand to controller
10—first location
12—second location
14—third location
16—room
18—entrance to room
20—heating or cooling source
22—reference location
24—radius from reference location
26—identification tag
28—zone controller of a comfort device
30—building
32—cell phone
34—comfort device controller
36—communication between cell phone and comfort device controller
38—router
40—communication between Global Positioning System (GPS) satellite and cell phone
42—internet Particular Advantages Of The Invention The present method enables the control of comfort devices based on the location of their user, thereby reducing wastes associated with providing services where they are not needed, reducing the amount of time required to provide sufficient services to their user and increasing the comfort experienced by their user.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

In controlling a comfort device based on user location, at least one effector of the comfort device must be associated with a zone within the influence of the at least one effector of the comfort device. Examples of effectors include but not limited to, dampers for controlling the distribution of (heated or cooled) air flow of a central air system, heat exchangers, internal recirculation and external recirculation effectors of water heaters and setpoint temperature control of water heaters and space heating or cooling systems.

Figure 1:
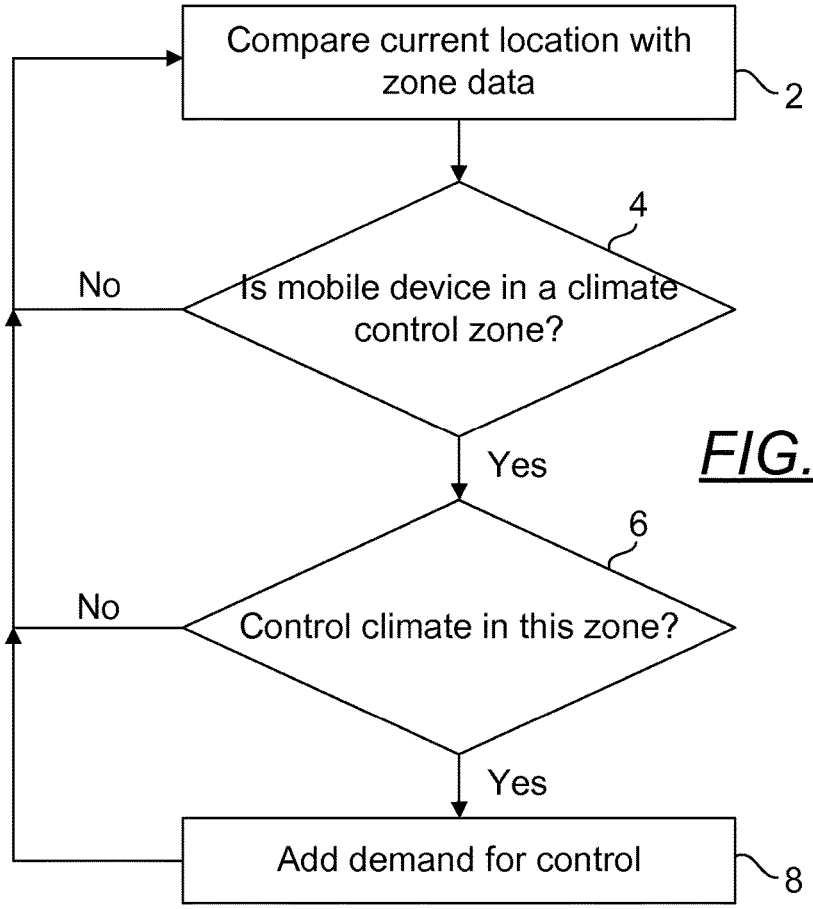
FIG. 1 is a flowchart depicting a process by which comfort devices may be controlled based on the location of one or more users of the comfort devices.

FIG. 1 is a flowchart depicting a process by which comfort devices may be controlled based on the location of one or more users of the comfort devices. In this example, a space heating or cooling device is used although such concept may be applied to other comfort devices, e.g., hot water system, refrigeration units, food preparation devices, etc. The location data of a user is first obtained and compared as in step 2 to pre-established zone data. It is then determined whether the user falls within a climate control zone as in step 4. It is then necessary to ensure, as depicted in step 6, that although the location data indicates that the current location falls within a climate control zone, climate control is desired. For instance, a user that has only been in a zone for a short period of time, e.g., seconds, may not intend to stay in the zone long enough to warrant starting climate control of the zone. In one example, if the user is determined to have been dwelling in a zone for over 20 seconds, climate control of the zone is now considered necessary. If climate control of a zone is considered necessary, a demand is then provided as in step 8 to the comfort device controller such that suitable effectors can be turned on to service the demand.

In one embodiment, a demand is associated with each user. The total demand for a zone is an aggregate of demands from all users in the zone. For example, in a three-zone building (with zones A, B and C), the total demands may be described as follows if there are m users in zone A, n users in zone B and zero users in zone C:

$$TzA=D1+D2+D3+Dm$$

$$TzB=D4+D5+Dn$$

$$TzC=0$$

Where Tz is the total demand for a zone (A, B or C), D is a demand associated with a user and each of m and n is the number of users in the zone A and B, respectively. Tz may be unity or may be greater than unity. In one embodiment, all zones are treated as equally importantly regardless of the number of users each of the zones has, i.e., each zone contributes an equal weight to the total demand Tz. In another embodiment, the importance of a zone may be weighted. In some embodiments, users may prefer to have an artificial base demand in each zone even without a true demand from a user such that the conditions across multiple zones are more even in order to anticipate demands of a user when the user transitions from one zone to another. In this case, TzA, TzB and TzC now become:

$$TzA=D1+D2+D3+Dm+D\text{base}$$

$$TzB=D4+D5+Dn+D\text{base}$$

$$TzC=D\text{base}$$

For example, a user may not prefer entering a completely non air-conditioned zone (e.g., zone C) after having acclimated to an air-conditioned zone (zone A or B). It is also possible that each demand is weighted according to preferences, e.g., whether a user is an adult or a child, or other factors. For example, the magnitude of D1 may not be the same as the magnitude of D2, D4, etc. as D1 is a demand associated with a user preferring a setpoint temperature of 68 degrees Fahrenheit and D2 is a demand associated with a user preferring a higher setpoint temperature of 72 degrees Fahrenheit. Therefore, if the demands are associated with cooling, the magnitude of D1 will be higher than the magnitude of D2 as the demand will need to be greater to make the temperature lower. In another example, if more users congregate in a zone, the Tz will rise for the zone, causing the importance of servicing the zone to increase, relative to another zone and hence increased amount of cooling relative to another zone having a lower number of users.

The total demand for the entire system is an aggregate of demands from all zones. In determining the settings appropriate for the total demand for a zone, a ratio of the total demand for the zone to the total demand for the entire system is calculated. In an example where dampers are used to distribute forced heated or cooled air, the settings of such dampers control the flowrate of heated or cooled air into a zone. For instance, if each damper is capable of being adjusted from a minimum flow setting to a maximum flow setting and there is more than one damper, the damper having the maximum ratio is adjusted to the maximum flow setting of all the dampers, the damper having other ratios are adjusted based on the their respective ratios as compared to the damper adjusted to the maximum flow setting.

Figure 2:
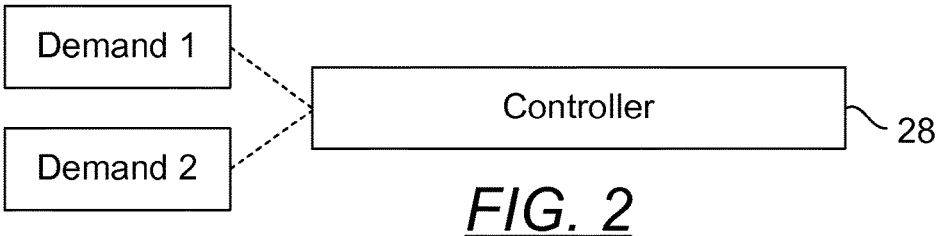
FIG. 2 is a diagram depicting the control of comfort devices based on one or more demands.

FIG. 2 is a diagram depicting the control of comfort devices based on one or more demands. In controlling a home comfort device, the controller 28 is configured to consider all demands. As disclosed elsewhere herein, there are two types of control mechanisms. In a first control mechanism, zone control is based on the presence of at least one demand in a zone, without regard to the magnitude of the at least one demand. Therefore, the presence of a demand in a zone simply represents a need to turn on one or more services in the zone. In a second control mechanism, zone control is based on the magnitude of the total demand present in a zone as compared to demands of other zones.

In one embodiment, in response to a demand, a comfort device controller adjusts the target setpoint temperature of a space heating or cooling system.

In one embodiment, in response to a demand, a comfort device controller adjusts the flow setting of one or more dampers to control the distribution of air flow in a space heating or cooling system.

In one embodiment, in response to a demand, a comfort device controller adjusts the starting point in time of an external recirculation or an internal recirculation of a water heating system to anticipate an imminent usage.

Within a building, e.g., a residence, office workspaces, industrial workspaces and warehouse spaces, centralized home comfort devices are often installed to service various spaces within the building. A centralized control system however is typically equipped with one sensor only for multiple rooms. The sensor acts a feedback device for a comfort device. For instance, a thermometer or thermostat provides the temperature of its surroundings to the heating or cooling system such that its control system can provide the appropriate heating or cooling rate and suitable setpoints to which the temperature is controlled. However, as the sensor is mounted in one of a plurality of spaces, only the space where the sensor is mounted is controlled to the setpoint of the heating or cooling control system. Therefore the specific needs of one or more for these comfort devices may not be met as the sensor, which may be placed in a common area of a building may not reflect the needs of the one or more individuals using another space in the building. In using the present control method in meeting the needs of one or more individuals in a building, the infrastructure available for such needs is preferably individualized, e.g., individual spaces may be controlled to specific temperature, using, e.g., automatically adjustable dampers etc. Although most existing buildings are not equipped such that zones can be made available, there is still value in controlling comfort devices based on current location of the users. For instance, during summer months in a typical household, the temperature of second floor spaces may be several degrees Fahrenheit higher than the spaces in the first floor. In a typical space heating or cooling system which has a feedback sensor only on the first floor, individuals may feel comfortable when they stay on the first floor during the day. However, during the night, the individuals may spend most of their time on the second floor as all of the bedrooms may be located on the second floor. If the zones are defined as the first and second floors, the setpoint of the sensor disposed on the first floor may be adjusted down such that the second floor temperature can be lowered as the setpoint of the first floor mounted sensor is lowered. Therefore, although the first floor may now be cooled to a lower than normal temperature, the second floor temperature is now comfortable for the individuals who all congregated on the second floor. One may argue that this can be accomplished simply by adjusting the setpoint according the time of day. However, such concept is useful only if the user's routine does not deviate from the pre-programmed settings. The present method ensures that the user's need is met without having to adhere to a pre-programmed routine. The present control system enables identification of a need based on the location of the need. Zones are preferably defined according to individual living spaces of individuals using comfort devices.

Figure 3:
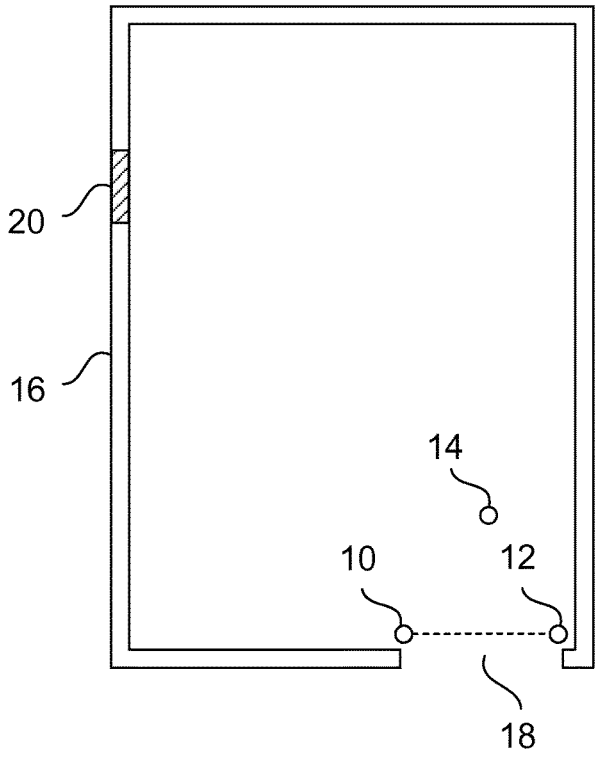
FIG. 3 is a diagram depicting a means by which a heating or cooling zone can be established.

FIG. 3 is a diagram depicting the means by which a heating or cooling zone can be established. In establishing a zone, such as a room 16 with a corresponding effector, e.g., heating and cooling system 20, a first location 10 is established by disposing a location providing equipment, e.g., a Global Positioning System (GPS) and taking location data at that location. This location will constitute a point in an imaginary vertical wall and this location is recorded as the first location. A second location 12 is established just as the first location was established but at a different location than the first location. Together, the first and second locations define an imaginary vertical wall that represents the entrance and exit gate to and from a zone. A third location 14 is established just as the way the first and second locations were established. However as the third location represents the side of the imaginary wall the zone is located, any locations determined to be on this side of the wall is considered located in this zone. This method is possible as the room 16 is generally enclosed with only one way to access the room, i.e., via the entrance 18.

Figure 4:
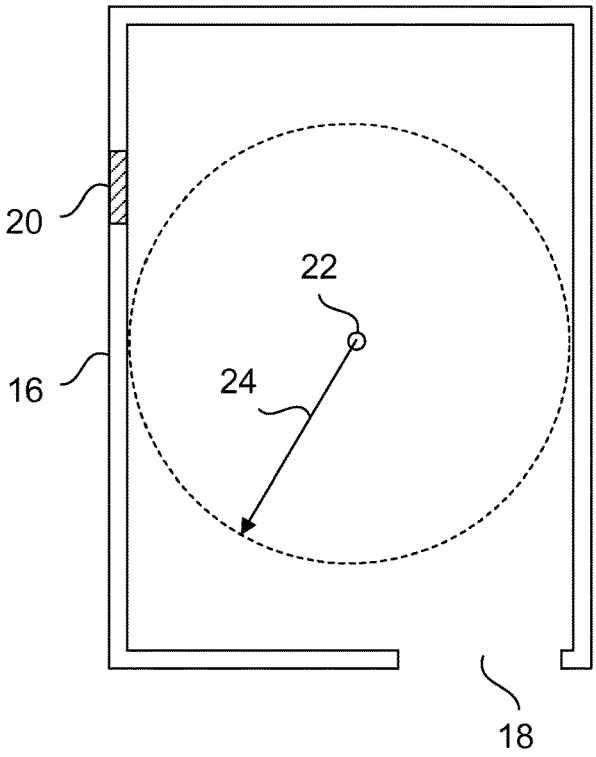
FIG. 4 is a diagram depicting another means by which a heating or cooling zone may be established.
Figure 5:
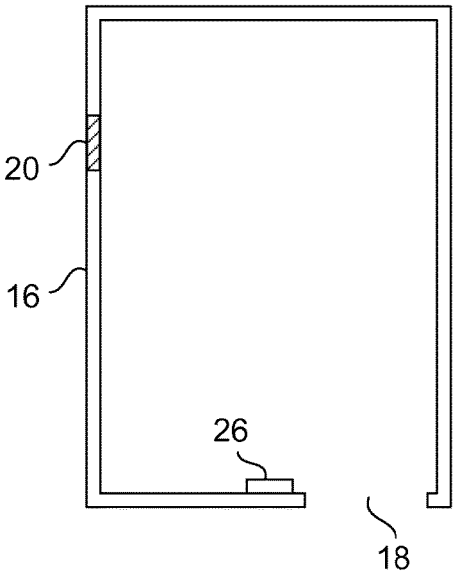
FIG. 5 is a diagram depicting yet another means by which a heating or cooling zone may be established.

FIG. 4 is a diagram depicting another means by which a heating or cooling zone may be established. In this embodiment, the concept of a zone is the distance of a mobile device from a pre-established reference location 22 using a location providing device, e.g., a GPS device. When the mobile device comes within a pre-selected radius or distance 24, e.g., 5 ft or boundary, from the pre-established reference location 22, the mobile device is said to have entered the zone. FIG. 5 is a diagram depicting yet another means by which a heating or cooling zone may be established. In this embodiment, the concept of a zone is the first detection of a pre-attached identification tag 26, e.g., a Radio Frequency Identification (RFID) tag or other short range identification devices, using an RFID receiver of a mobile device. In one embodiment, a second subsequent detection indicates the desire to remove services provided to the zone. The mobile device can include, but not limited to, a cell phone, a Personal Digital Assistant (PDA) and an electronic pad, a smart phone, key fob, tablet and a Global Positioning System (GPS) device.

Figure 6:
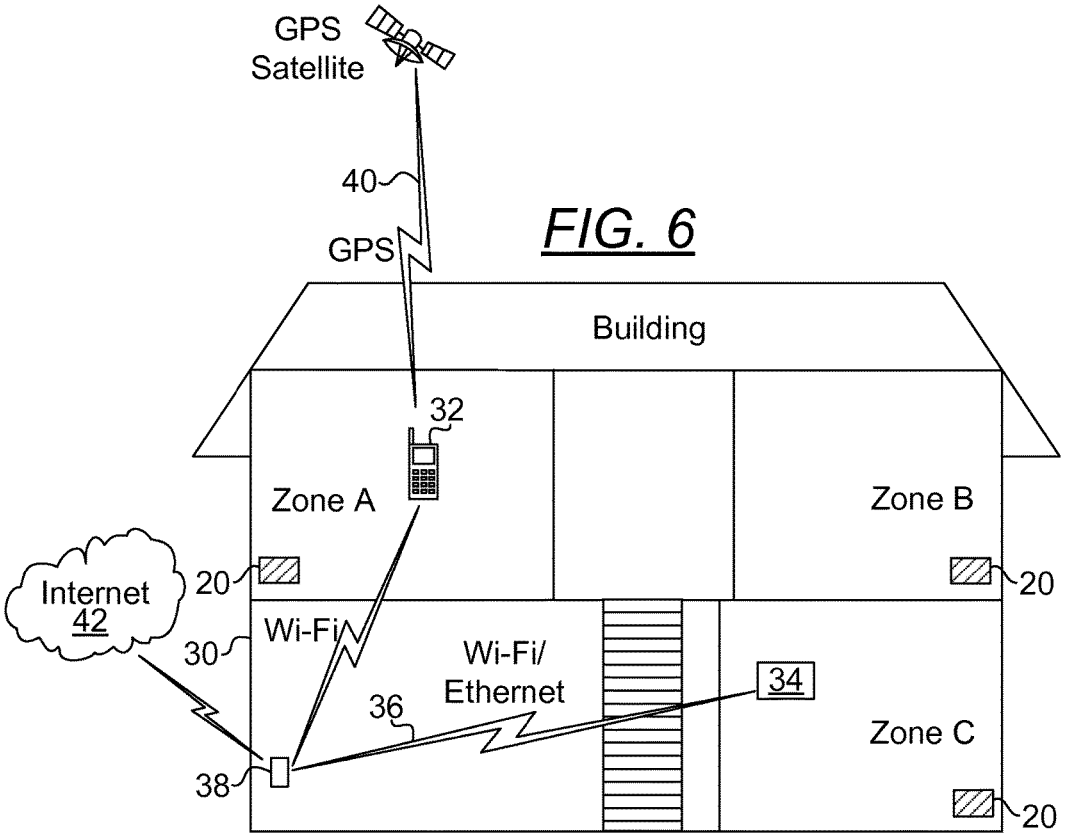
FIG. 6 is a diagram depicting communication between a mobile device capable of location reporting and a comfort device controller.

FIG. 6 is a diagram depicting communication between a mobile device capable of location reporting and a comfort device controller adapted to service spaces in a building 30. Location information is sourced periodically from, e.g., a satellite via GPS communication 40 or a cellular network by a mobile device 32, e.g., a cell phone. The frequency at which location data is sourced may be adjusted according to user preferences. In general, as any communication the cell phone makes with any equipment consumes power, the frequency at which location data is sourced should be kept to a minimum to conserve the cell phone power. In one embodiment, location sourcing is started only when motion is detected in the cell phone, e.g., via vibration sensor, etc. and maintained for a pre-determined amount of time after it is started. The location information is then transmitted via a communication protocol, e.g., Wide-Fidelity (Wi-Fi) to a router 38. As the comfort device controller 34 is also operably connected to the router 38 via Wi-Fi or Ethernet connection, the location data is communicated via Wi-Fi or Ethernet communication 36 to the comfort device controller 34 which subsequently determines the zone in which the cell phone 32 is located. Alternatively, the cell phone 32 may be configured to communicate with a remote application via the internet 42 such that processing of the location data can be performed in the remote application and the results, e.g., zone information, can be communicated back to the comfort device controller 34 for execution locally. In addition, the damper settings may also be calculated in the remote application and communicated back to the comfort device controller 34 for execution.

In controlling the removal of a service to a zone, a delay may be used to ensure that a demand for the zone has truly ceased. For instance, upon detecting the removal of a demand from a zone, a timer is started which upon its expiration, causes a check to be again performed to ensure the previous demand has not returned or a new demand has not been initiated such that one or more services for the zone can be removed.

In another embodiment, no mobile devices are necessary in detecting whether a user has entered or exited a zone. A device capable of detecting the presence of an object or an individual in a zone, e.g., a motion detector, may be used. Upon detecting the presence of an object or individual, a demand is communicated to the controller of a comfort device. This embodiment may be used in place of or in conjunction with the user location scheme disclosed elsewhere herein. The sensitivity of a motion detector shall be considered when such a device is used. For instance, a motion detector shall not be adjusted to a setting that is so sensitive that it will detect motions caused when an individual is not in an intended zone.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A method of controlling a comfort device having at least one effector capable of meeting the demand of at least a user, said method comprising steps of:

(a) establishing at least one zone in which at least one service of a comfort device is provided, wherein said establishing step comprises establishing a first location by disposing a location providing equipment at said first location and taking location data at said first location, establishing a second location by disposing the location providing equipment at said second location and taking location data at said second location, establishing a third location by disposing the location providing equipment at said third location in said at least one zone and taking location data at said third location, establishing a single imaginary vertical wall intersecting said first location and said second location, said single imaginary vertical wall representing an entrance to said at least one zone and said third location representing the side of said single imaginary vertical wall said at least one zone is disposed, such that the at least one user can be considered as being present within said at least one zone if the location of the at least one user is on the same side of said single imaginary vertical wall as said third location and the at least one user can be considered as being not present within said at least one zone if the location of the at least one user is on the opposite side of said single imaginary vertical wall as said third location;

(b) associating the at least one effector of said comfort device with said at least one zone;

(c) determining the presence of the at least one user in said at least one zone by determining whether the at least one user is located on the same side of said single imaginary vertical wall as said third location; and (d) upon detecting the presence of the at least one user in said at least one zone, controlling the comfort device to meet the demand of the at least one user.

2. The method of claim 1, wherein said determining step comprises comparing a user location obtained via a mobile device to the location of said at least one zone.

3. The method of claim 2, wherein said mobile device is a device selected from the group consisting of a cell phone, a Personal Digital Assistant (PDA), an electronic pad, a smart phone, a key fob, a tablet and a Global Positioning System (GPS) device.

4. The method of claim 1, wherein said controlling step comprises controlling the comfort device without considering the magnitude of the demand of the at least one user and controlling the comfort device by considering the presence of the demand of the at least one user in said at least one zone.

5. The method of claim 1, wherein said controlling step comprises controlling the comfort device based on the magnitude of the demand of the at least one user.

6. The method of claim 1, further comprising associating a base demand to said at least one zone prior to said controlling step and in addition to controlling the comfort device to meet the demand of the at least one user, said controlling step further controls the comfort device to meet said base demand.

7. The method of claim 1, wherein said establishing step comprises establishing a reference location and a boundary disposed at a pre-selected distance from said reference location to define said at least one zone.

8. The method of claim 1, wherein said establishing step comprises detecting a Radio Frequency Identification (RFID) tag to further define said at least one zone.

9. The method of claim 1, wherein the comfort device is a device selected from the group consisting of a water heating system, a space heating system and a space cooling system.

10. The method of claim 1, wherein said determining step comprises detecting a motion within said at least one zone.

* * * * *